United States Patent [19]

Cobiski

[11] Patent Number: 4,559,930

[45] Date of Patent: Dec. 24, 1985

[54] THORACIC BENCH

[76] Inventor: John F. Cobiski, Box 189, Rte. 20, Charlton, Mass. 01507

[21] Appl. No.: 607,976

[22] Filed: May 7, 1984

[51] Int. Cl.[4] ..... A61G 13/00

[52] U.S. Cl. ..... 128/70; 269/328

[58] Field of Search ..... 128/68–74; 269/322, 328; 5/60; 297/461

[56] References Cited

U.S. PATENT DOCUMENTS 1,904,039 4/1933 Bruder ..... 128/69

3,271,028 9/1966 Albin ..... 269/328

3,747,916 7/1973 Benson ..... 128/70

*Primary Examiner*—Jay N. Eskovitz

*Attorney, Agent, or Firm*—Charles R. Fay

[57] ABSTRACT

A therapeutic bench for extending the thoracic cage and cervical areas of the body, comprising an elongated, horizontal support, a shorter thoracic cage support thereon, the bench being made to support only the sternum and chin with arms and head unsupported when a person sits on the support and lies prone as to the torso.

3 Claims, 4 Drawing Figures

FIG. 1
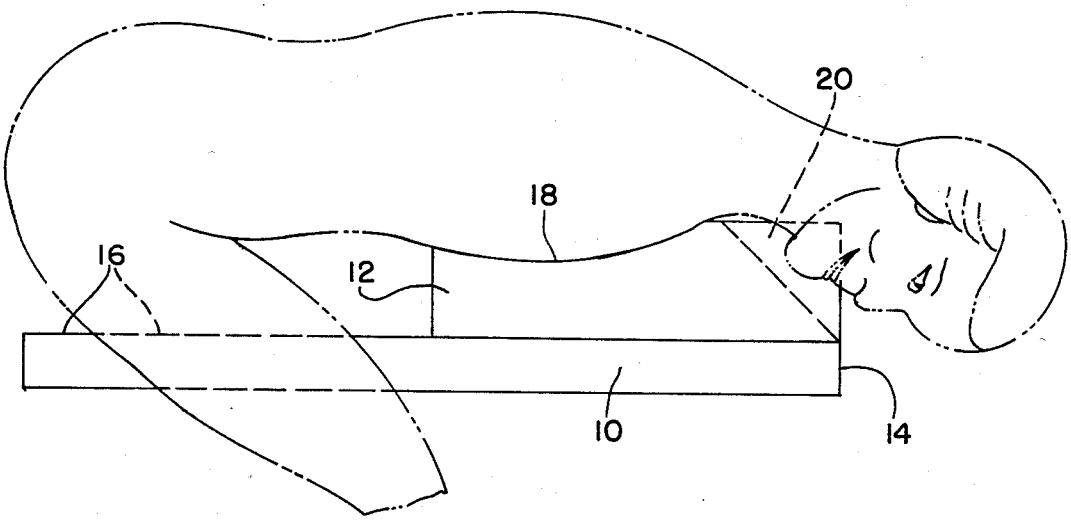
FIG. 2
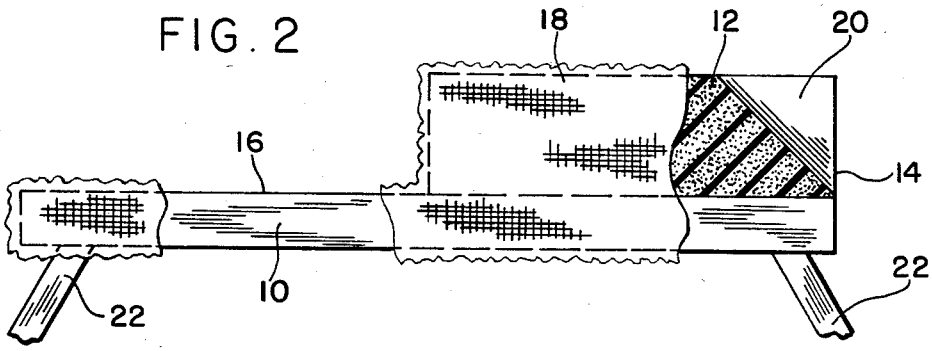
FIG. 3
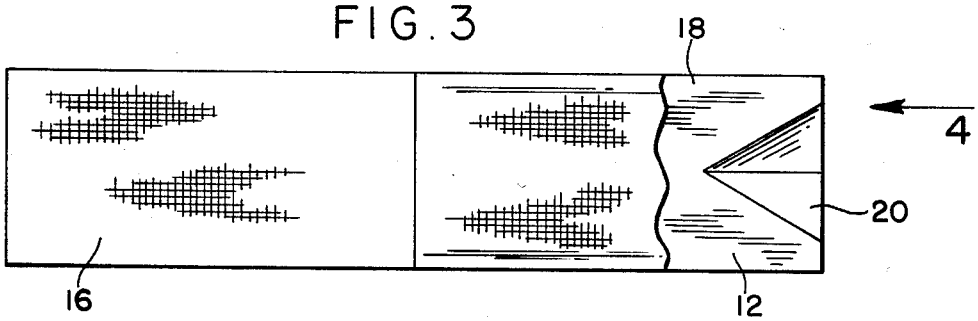
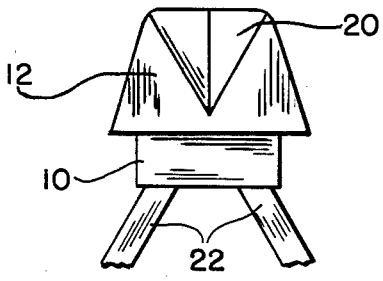
FIG. 4

THORACIC BENCH

FIELD OF THE INVENTION

In therapeutics, a support for the human body in general prone position, extending the upper torso and cervical areas (as well as the entire spine) for the relief of muscle strain and nerve pressure.

BACKGROUND OF THE INVENTION

Aches and pains in the spine, especially in the lower and upper parts, can often be relieved by stretching the spine, and this is pointed out in my U.S. Pat. No. 4,396,012, Aug. 2, 1983, which discloses an apparatus for stretching in the lower spinal area. In the present case, a very simple but effective device is proposed for stretching the entire spine to some degree but especially treating the thoracic and cervical area.

SUMMARY OF THE DISCLOSURE

Supported in any way desired or convenient, a horizontal body-supporting bench is provided which comprises a seat or sitting area at one end and a raised sternum-supporting portion forming the remainder of the bench preferably with a pivot point "cut-out" end portion to accommodate the chin and allow it to hang freely. The patient pivots down, resting the sternum on the raised support, with chin in the opening provided, so that the thorac tends to be extended by body weight and the cervical vertebrae extended by the pivoting forward of the head on the chin. The arms hang freely, unsupported. The legs, with the feet firmly on the floor, support the pelvis.

The seat may be any size or shape, preferably capable of accepting various sizes and shapes. The raised block-like sternum support is preferably made of high density foam, giving firm support, and the entire bench may be suitably covered, as by rubber, pneumatic, or other materials, such as sheep-skin, hide, or the like. In any event, even relatively small periods of treatment have been found to be effective in many cases and the patient needs to do nothing except to lie on the bench (not even removed clothing) in order to achieve the benefits of the invention.

If found advisable, any desired means to vary the elevation of the bench may be provided.

BRIEF DESCRIPTION OF THE DRAWINGS

FIG. 1 is a diagram illustrating the invention;

FIG. 2 is a side elevational view of a form of bench, part in section, and cover cut away in part;

FIG. 3 is a top plan view thereof; and

FIG. 4 is an end view of the bench looking in the direction of arrow 4 in FIG. 3 with the cover removed.

PREFERRED EMBODIMENT OF THE INVENTION

The bench itself is best shown in FIGS. 2–4; FIG. 1 illustrates the way in which the bench is used and its beneficial effects.

There is a support 10 which is elongated and narrow and of a size to support a human body, as from the buttocks to the head. The dimensions of this support are not important per se, and the material may be anything suitable, such as wood, metal, plastic, or the like, but it must be relatively stiff and rugged for the purpose for which it is used.

On the support there is an elongated block 12 of suitable body supporting material, e.g., high density plastic foam which will support the human body firmly concentrating the weight on the sternum but at the same time with a degree of comfort so that it conforms to some extent to the shape of the human body. This block 12 is set onto the support 10 and may be attached thereto if desired, flush with one end of the support as at 14 and extending inwardly from there for a portion only of the support, leaving the support unencumbered at its opposite end as at 16. The block of plastic foam material is preferably formed to have a smaller surface area on the top than the bottom, with the sides of same tapering from the narrower top to the wider bottom. This configuration allows the female bust to be unaffected and concentrates the body weight on the sternum or center of the thorac. It may also be made concave as at 18, if desired.

At the end portion of block 12 that is flush with the support, there is a depression or recess 20 to accommodate the chin of the patient, the configuration being such that the weight of the head thrusts the head down and forward there being no support for it, and this causes the cervical vertabrae to become extended. The whole bench, or any part or parts thereof, may be covered with suitable material, such as padding, sheep-skin, rug material, etc. should be found desirable either from a cosmetic aspect or for comfort. Also, the support and bench may be supported as by legs 22, steel frames, etc., and may be made adjustable, although a single height is found to accommodate almost all adults, whereas children do not often need the therapeutic advantages of this invention.

I claim:

1. A bench for cervical treatment comprising a narrow elongated horizontal support, legs for the support raising it to a predetermined elevation, a narrow elongated block member on and parallel to the support, said member being shorter than the support and located at an end portion thereof, leaving one opposite end portion of the support free for a person to straddle while facing the member, the free portion of the support forming a seat for the person straddling the same and the member forming a support for the upper body of the person prone from the hips up, said member having a narrower upper surface than the lower surface thereof, the sides of the member tapering convergently upwards, the narrow upper surface being of a width to support the sternum only of the person prone thereon.

2. The bench of claim 1 including a recess in the member at the upper surface thereof said recess being located at the end of the block member opposite the free portion of the support.

3. The bench of claim 2 wherein the support and member are substantially co-terminous at the ends thereof adjacent the recess.

* * * * *